US010588403B2

(12) United States Patent
Paul et al.

(10) Patent No.: US 10,588,403 B2
(45) Date of Patent: Mar. 17, 2020

(54) METHOD AND APPARATUS FOR RAISING AND LOWERING OF DESK WITHIN A WORK SURFACE

(71) Applicants: Anthony A. Paul, Caledonia, IL (US); Joseph G. Paul, Belvidere, IL (US)

(72) Inventors: Anthony A. Paul, Caledonia, IL (US); Joseph G. Paul, Belvidere, IL (US)

( * ) Notice: Subject to any disclaimer, the term of this patent is extended or adjusted under 35 U.S.C. 154(b) by 0 days.

(21) Appl. No.: 16/107,251

(22) Filed: Aug. 21, 2018

(65) Prior Publication Data

US 2019/0059574 A1 Feb. 28, 2019

Related U.S. Application Data

(60) Provisional application No. 62/548,652, filed on Aug. 22, 2017.

(51) Int. Cl.

| | |
|---|---|
| ***A47B 21/02*** | (2006.01) |
| ***A47B 9/02*** | (2006.01) |
| *A47B 9/20* | (2006.01) |

(52) U.S. Cl.

CPC ..... *A47B 21/02* (2013.01); *A47B 9/02* (2013.01); *A47B 9/20* (2013.01); *A47B 2200/0001* (2013.01); *A47B 2200/004* (2013.01); *A47B 2200/0046* (2013.01); *A47B 2200/0054* (2013.01)

(58) Field of Classification Search

CPC ..... A47B 21/00; A47B 21/02; A47B 9/02; A47B 9/20; A47B 9/10; A47B 2200/0001; A47B 2200/004; A47B 2200/0046; A47B 2200/0054; A47B 2200/0066

USPC ..... 108/147, 147.19, 50.01, 50.02

See application file for complete search history.

(56) References Cited

U.S. PATENT DOCUMENTS

| | | | | |
|---|---|---|---|---|
| 5,265,952 | A | 11/1993 | Greshem | |
| 5,322,025 | A * | 6/1994 | Sherman | A47B 9/10 108/147 |
| 5,461,974 | A * | 10/1995 | Reneau | A47B 9/04 108/147 |
| 5,752,448 | A | 5/1998 | Eyre | |
| 5,823,120 | A * | 10/1998 | Holmquist | A47B 9/02 108/147 |
| 5,857,415 | A * | 1/1999 | Richard | A47B 21/0073 108/10 |

(Continued)

FOREIGN PATENT DOCUMENTS

| | | |
|---|---|---|
| DE | 202012006283 | 8/2012 |
| EP | 3123899 | 2/2017 |

(Continued)

*Primary Examiner* — Jose V Chen

(74) *Attorney, Agent, or Firm* — Knechtel, Demeur & Samlan

(57) ABSTRACT

A desk within a work surface or table such that the desk can be raised and lowered to any desired position in relation to the work surface using an actuator that controls the use of telescoping legs or rods. During the process of returning the desk back to its original flush, or in horizontal seamless alignment with, the rest of the work surface, a knee action safety device co-acts, or in combination, with a gas spring is used for controlling the lowering of the desk and creating a virtually weightless of desk during final descent; thus, eliminating the possibility of a person's limb or hand being crushed or severely injured, even if these are providing obstruction.

13 Claims, 6 Drawing Sheets

(56) References Cited

U.S. PATENT DOCUMENTS 6,092,474 A * 7/2000 Chen ..... A47B 9/10 108/147
6,286,441 B1 9/2001 Burdi
6,296,408 B1 * 10/2001 Larkin ..... A47B 83/001 400/681
6,352,037 B1 * 3/2002 Doyle ..... A47B 9/00 108/147
6,474,246 B2 * 11/2002 Hsu ..... A47B 9/04 108/147
6,536,356 B2 * 3/2003 Krieger ..... A47B 21/00 108/10
6,705,239 B2 * 3/2004 Doyle ..... A47B 9/04 108/147
7,398,738 B2 * 7/2008 Newhouse ..... A47B 9/18 108/147
7,862,409 B1 1/2011 Sheppard
8,051,782 B2 * 11/2011 Nethken ..... A47B 21/02 108/50.01
8,087,737 B2 * 1/2012 Shoenfeld ..... A47B 21/02 108/147.19
8,783,193 B2 * 7/2014 Scharing ..... A47B 21/00 108/102
8,947,215 B2 * 2/2015 Mandel ..... G06Q 10/109 108/147
8,991,320 B2 * 3/2015 DesRoches ..... A47B 21/02 108/50.01
9,072,376 B2 7/2015 Wagner
9,345,318 B2 5/2016 Kollreider
9,921,726 B1 * 3/2018 Sculley ..... H04L 9/3231
2005/0150437 A1 * 7/2005 Chen ..... A47B 9/10 108/147
2005/0247239 A1 11/2005 Newhouse
2009/0078167 A1 * 3/2009 Ellegaard ..... A47B 9/00 108/21
2014/0020606 A1 1/2014 Benden
2014/0208986 A1 * 7/2014 DesRoches ..... A47B 9/20 108/22
2015/0096472 A1 * 4/2015 Papic ..... A47B 9/20 108/28
2018/0279772 A1 * 10/2018 Ergun et al. ..... A47B 9/02
2019/0098994 A1 * 4/2019 Smed ..... A47B 21/02

FOREIGN PATENT DOCUMENTS

GB 2542196 3/2017
WO 2000044262 8/2000

* cited by examiner

METHOD AND APPARATUS FOR RAISING AND LOWERING OF DESK WITHIN A WORK SURFACE

I. CROSS-REFERENCE TO RELATED APPLICATION

This patent application is a non-provisional application claiming priority from U.S. Provisional Patent Application Ser. No. 62/548,652, entitled "Method and Apparatus For Raising and Lowering of Desk Within A Work Surface", filed on Aug. 22, 2017, and is fully incorporated herein by reference.

II. FIELD OF THE INVENTION

The present invention relates to a unique method and apparatus for raising and lowering a desk within a work surface or table and, in particular, providing a knee action safety device co-acting, or in combination, with a gas spring for controlling the lowering of the desk and creating a virtually weightless desk during its final descent; thus, eliminating the possibility of a person's limb or hand being crushed or severely injured.

III. BACKGROUND AND DESCRIPTION OF THE INVENTION

The following identified patents, listed below by issuance order, were revealed relative to adjusting the height of a desk, tabletop, or work station:

| Inventor | Issued/Published | Title of Patent | U.S. Pat. No. |
|---|---|---|---|
| Phillips | Mar. 15, 2017 | Sit Stand Desk and Bench Desk System Comprising the Same | GB 2542196 |
| Carlo | Feb. 1, 2017 | Table With Operating Units Adjustable In Height | EP 3123899 |
| Daniel | May 24, 2016 | Table With A Height Adjustable Tabletop | U.S. Pat. No. 9,345,318 |
| Isaac | Jul. 7, 2015 | Teaching Station With Adjustable Lectern Section | U.S. Pat. No. 9,072,376 |
| Benden | Jan. 23, 2014 | Adjustable Footrest for Adjustable Height Desk | US 2014/0020606 |
| Unknown | Aug. 2, 2012 | Height Adjustable Table | DE202012006283 |
| Nethken | Nov. 8, 2011 | Desk and Display Stand With Height and Depth Adjustment | U.S. Pat. No. 8,051,782 |
| Sheppard | Jan. 4, 2011 | Motorized Height-Adjustable Table Apparatus | U.S. Pat. No. 7,862,409 |
| Newhouse | Nov. 10, 2005 | Adjustable Height Casegood and Desk | US 2005/0247239 |
| Burdi | Sep. 9, 2001 | Height Adjustable Work Surface And Control Therefor | U.S. Pat. No. 6,286,441 |
| Kent | Aug. 3, 2000 | Height Adjustable Table | WO2000044262 |
| Eyre | May 19, 1998 | Motorized Table | U.S. Pat. No. 5,752,448 |
| Greshem | Nov. 30, 1993 | Operator Work Station | U.S. Pat. No. 5,265,952 |

Each of the prior art issued patents or published patent applications uncovered reveals a method or system relating to adjusting the height of a desk, tabletop, or work station. However, each of these devices in the prior art patents disclose a method or system that is limited in its application and/or different than Applicant's invention or device, which has solved a safety problem created by adjustable desks, tabletops, or work stations having one portion of the desk, tabletop, and/or work station that is moveable in relation to an adjacent stationary portion of the desk, tabletop, and/or work station.

Thus, there is a need, therefore, and there has never been disclosed Applicant's unique method for raising and lowering a desk within a work surface or table and, in particular, providing a knee action safety device co-acting, or in combination, with a gas spring for controlling the lowering of the desk and creating a virtually weightless desk during its final descent; thus, eliminating the possibility of a person's limb or hand being crushed or severely injured.

IV. SUMMARY OF THE INVENTION

The present invention is a desk within a work surface or table such that the desk can be raised and lowered to any desired position in relation to the work surface using an actuator that controls the use of telescoping legs or rods. During the process of returning the desk back to its original flush, or in horizontal seamless alignment with, the rest of the work surface, a knee action safety device co-acts, or in combination, with a gas spring is used for controlling the lowering of the desk and creating a virtually weightless of desk during final descent; thus, eliminating the possibility of a person's limb or hand being crushed or severely injured, even if these are providing obstruction.

V. BRIEF DESCRIPTION OF THE DRAWINGS

The Description of the Preferred Embodiment will be better understood with reference to the following figures.

Figure 5:
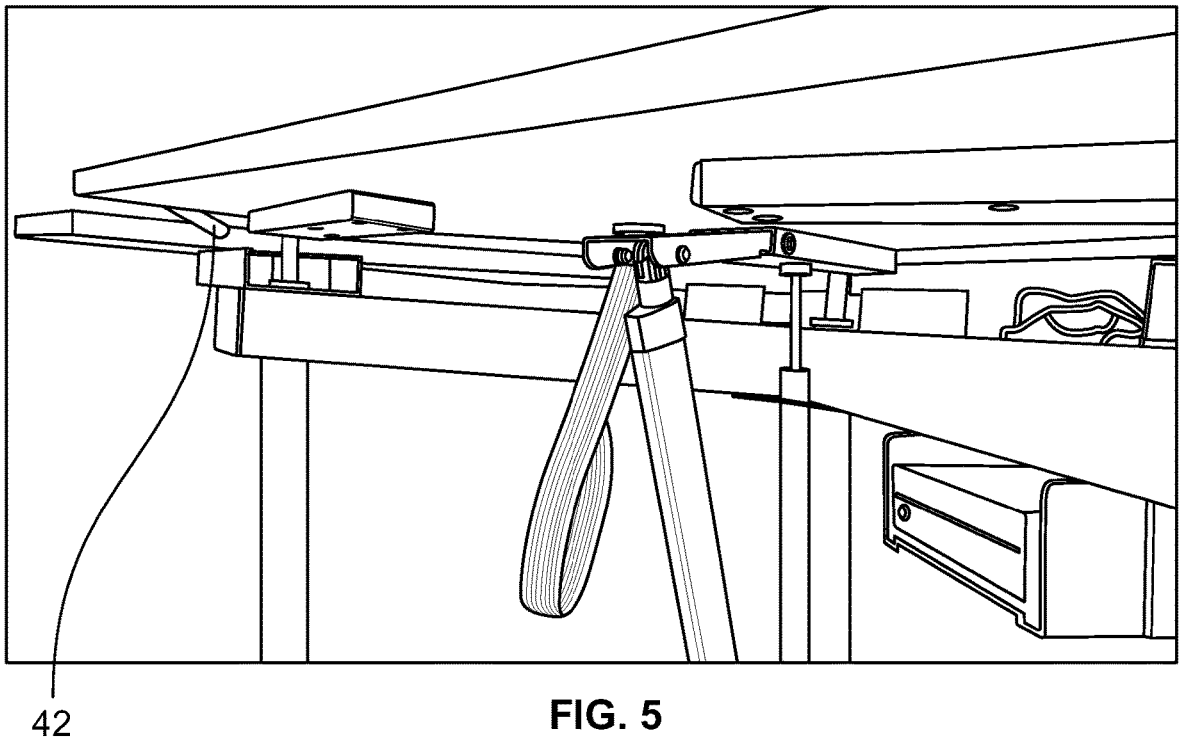

FIG. 5 is a front perspective view of the continuing process of lowering the desk back to its original flush, or in horizontal seamless alignment with, the rest of the work surface; and in particular, illustrating disengagement of the knee action safety device and the engagement of the gas spring as the desk begins the final descent. Also, illustrated is a carrot (non-limiting example) providing an obstruction between the desk and work surface during this final descent and the gas spring absorbing the majority of the weight of the desk to prevent damage to the obstruction.

Figure 6:
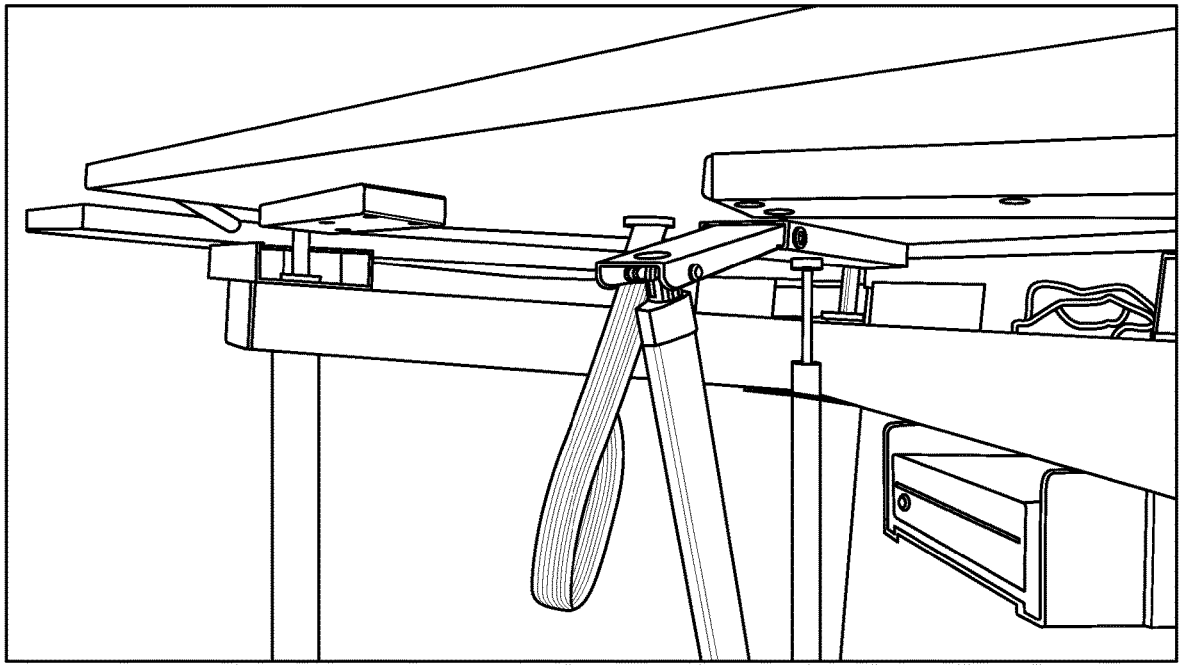

FIG. 6 is a front perspective view of the continuing process of lowering the desk back to its original flush, or in horizontal seamless alignment with, the rest of the work surface; and in particular, illustrating the disengaged knee action safety device and continual engagement of the gas spring during this final descent. Also, illustrated is a carrot (non-limiting example) continuing to provide an obstruction between the desk and work surface during this final descent and the gas spring absorbing the majority of the weight of the desk to prevent damage to the obstruction.

Figure 7:
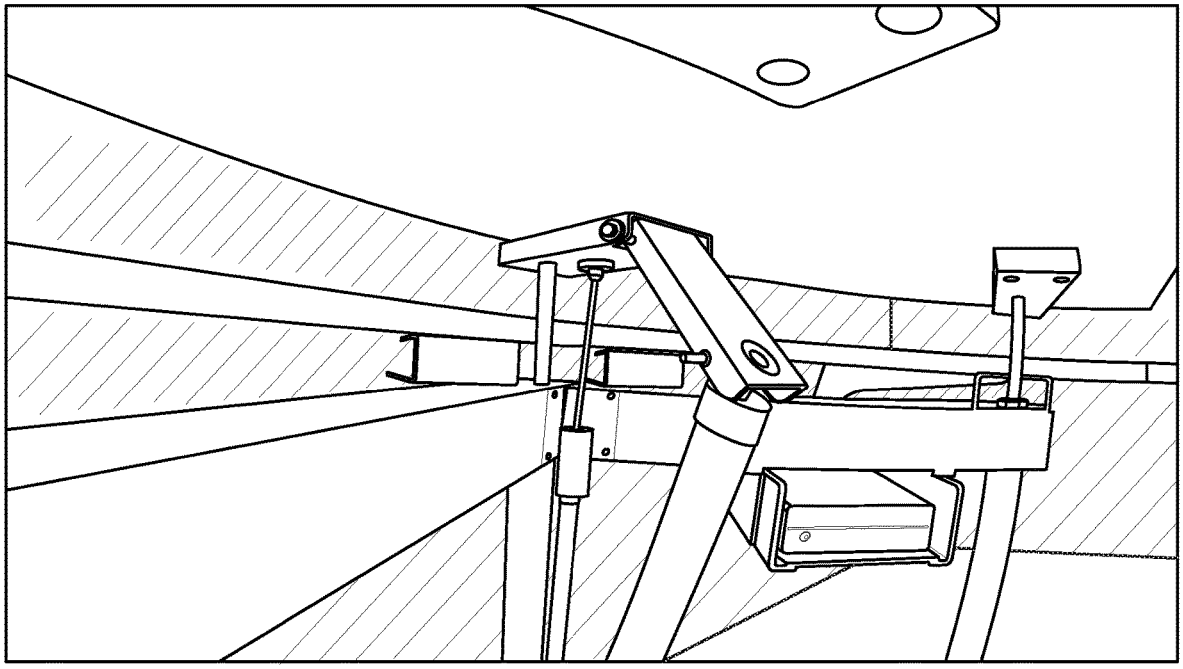

FIG. 7 is a front perspective partial view during the lowering of the desk back to its original flush, or in horizontal seamless alignment with, the rest of the work surface; and in particular, illustrating the disengaged knee action safety device continuing downwardly and separated away from the desk with the remaining engagement of the gas spring to the desk as the desk during this final descent.

Figure 8:
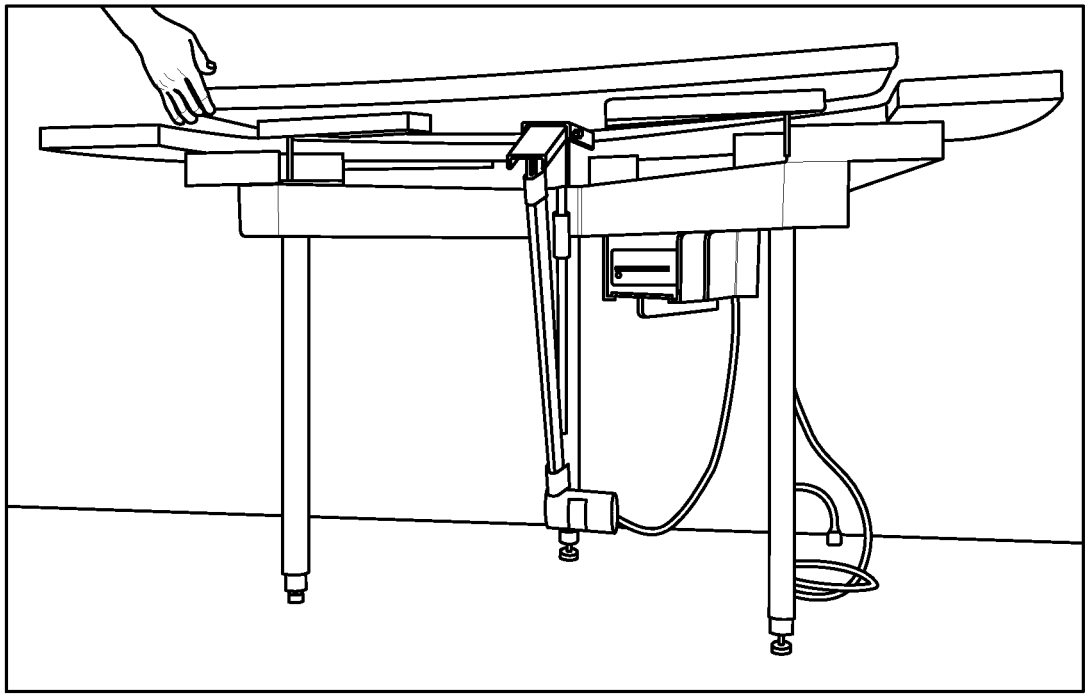

FIG. 8 is a front perspective view of the continuing process of lowering the desk back to its original flush, or in horizontal seamless alignment with, the rest of the work surface; and in particular, illustrating the removal of the obstruction between the desk and the work surface to allow the gas spring to re-engage with the weight of the desk slowly continuing to complete the final descent.

Figure 9:
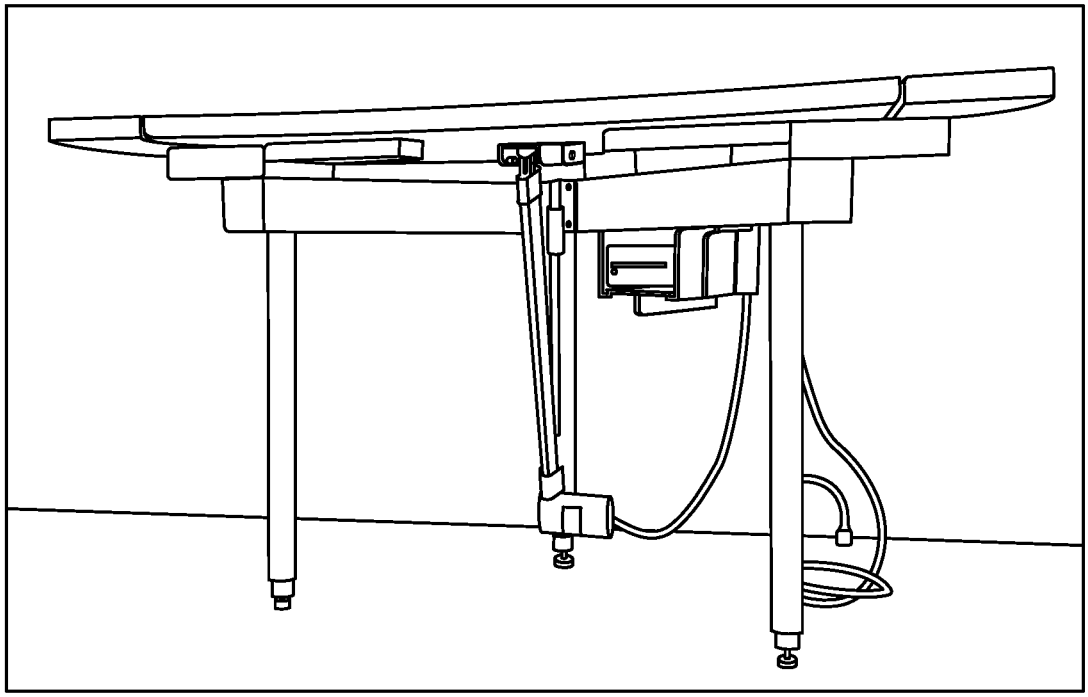

FIG. 9 is a front perspective view of the completion of the process of lowering the desk back to its original flush, or in horizontal seamless alignment with, the rest of the work surface; and in particular, illustrating once the removal of the obstruction between the desk and the work surface, the gas spring re-engages with the weight of the desk and slowly continues to complete the final descent.

Figure 10:
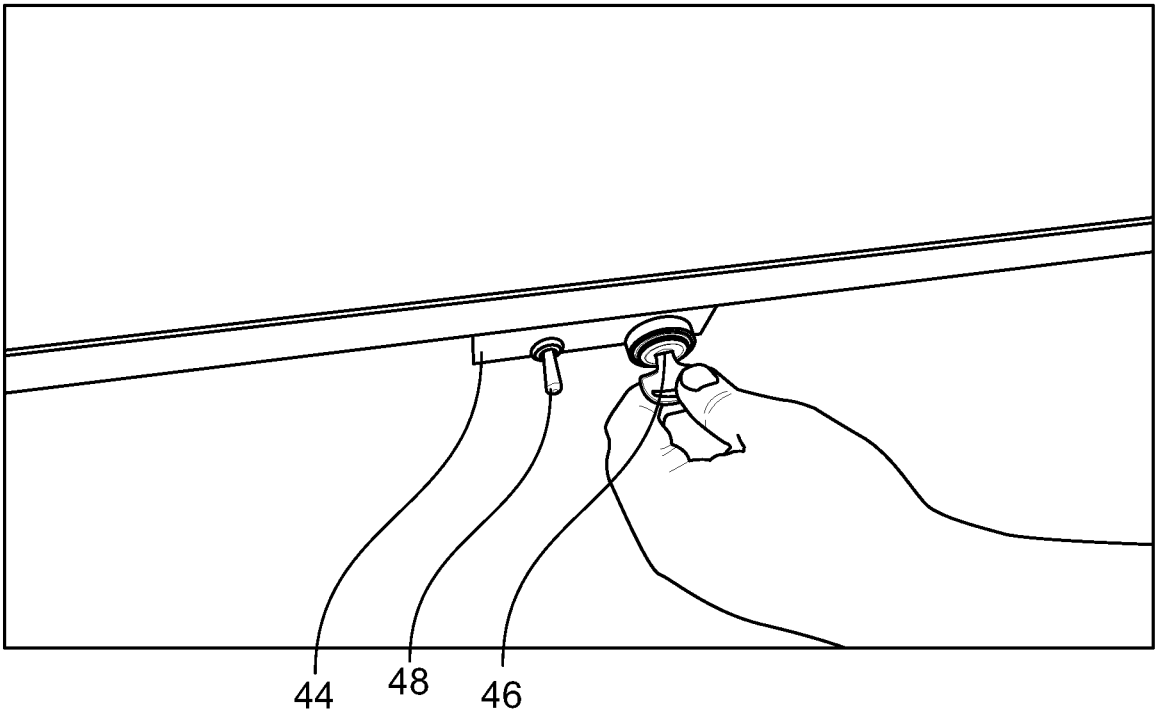

FIG. 10 is a front perspective view of the switches and keys for operating Applicant's device.

VI. DETAILED DESCRIPTION OF THE PREFERRED EMBODIMENT

Figure 1:
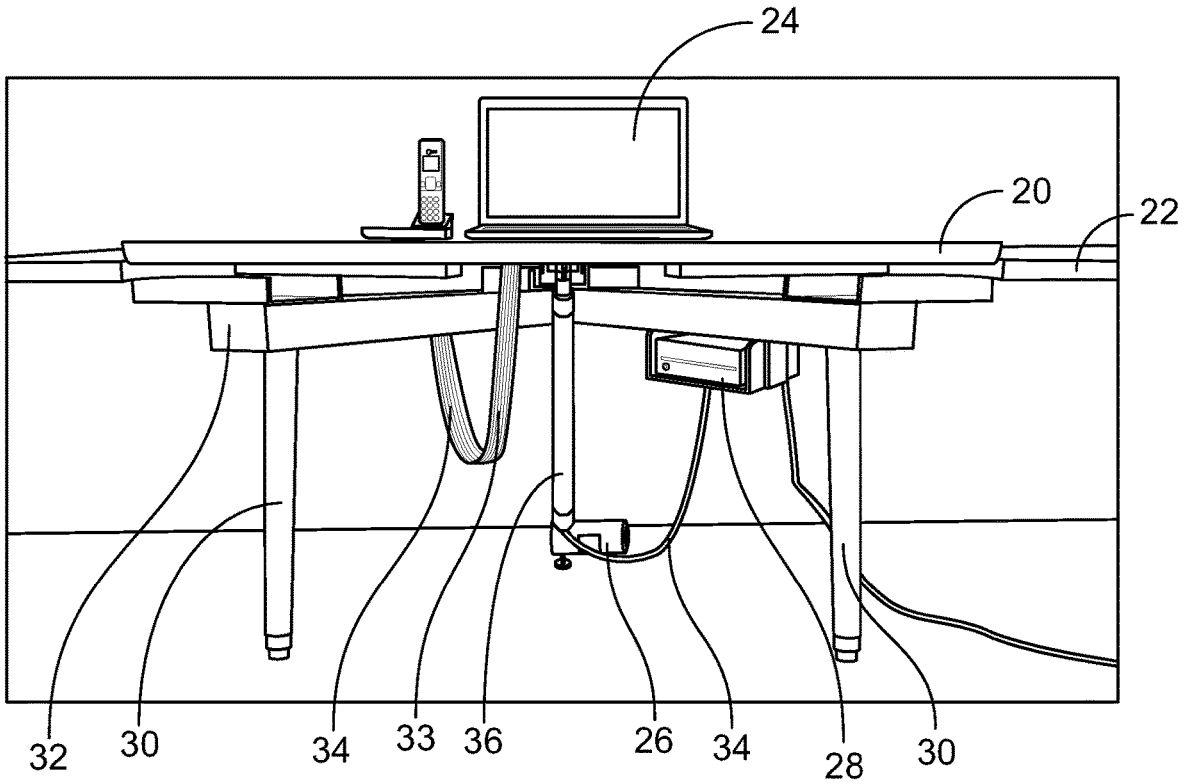
FIG. 1 is a front view of Applicant's invention and, in particular, illustrates the desk that is integrated, or part of, the work surface including the computer workstation devices, electrical cables, single actuator, and power supply.

The invention is the safe method and apparatus for raising and lowering a desk which is integrated, or part of, the work surface. Turning first to FIG. 1, there is illustrated a desk 20 that is integrated, or part of, a work surface or table 22. Sitting on top of the desk 20 is the computer workstation devices 24 which includes but is not limited to a computer, telephone, printer, files, and any other hardware or other tangible material desired by the user.

In the preferred embodiment, a single actuator 26 is provided for raising and lowering the adjusting position of the desk 20 through the use of three telescoping legs or rods 30. Each of these three telescoping legs or rods 30 are aligned with linear bearings and fixed to a chassis 32, which are independent of the actuator 26. In the preferred embodiment, these three telescoping legs or rods 30 maintain the horizontal alignment of the desk 20 even if the computer workstation devices 24 are still on the movable portion of the desk 20 (i.e., while the desk 20 is being raised and/or lowered). In particular, these three telescoping legs or rods 30 only provide stability and do not provide any pulling or pushing action in connection with the movement of the desk 20. As discussed below, the movement of the desk 20 is controlled by the knee action safety device and gas spring 40 (see FIG. 3).

The computer workstation devices 24 and the actuator 26 are powered by a power supply source 28. Preferably, this power supply source 28 is a Samlex SEC-1223 power supply. Alternatively, any power supply source 28 may be used provided that it accomplishes the invention described herein. Various electrical cables 34 connect these peripherals and, in some cases, are contained within a flexible tubing 33 or remain exposed, as desired. Preferably, the use of the flexible tubing 33 permits the movement of the desk 20 in relation to the work surface or table 22 without affecting the electrical cables 34 and likewise eliminating the electrical cables 34 from causing or preventing this movement.

Figure 2:
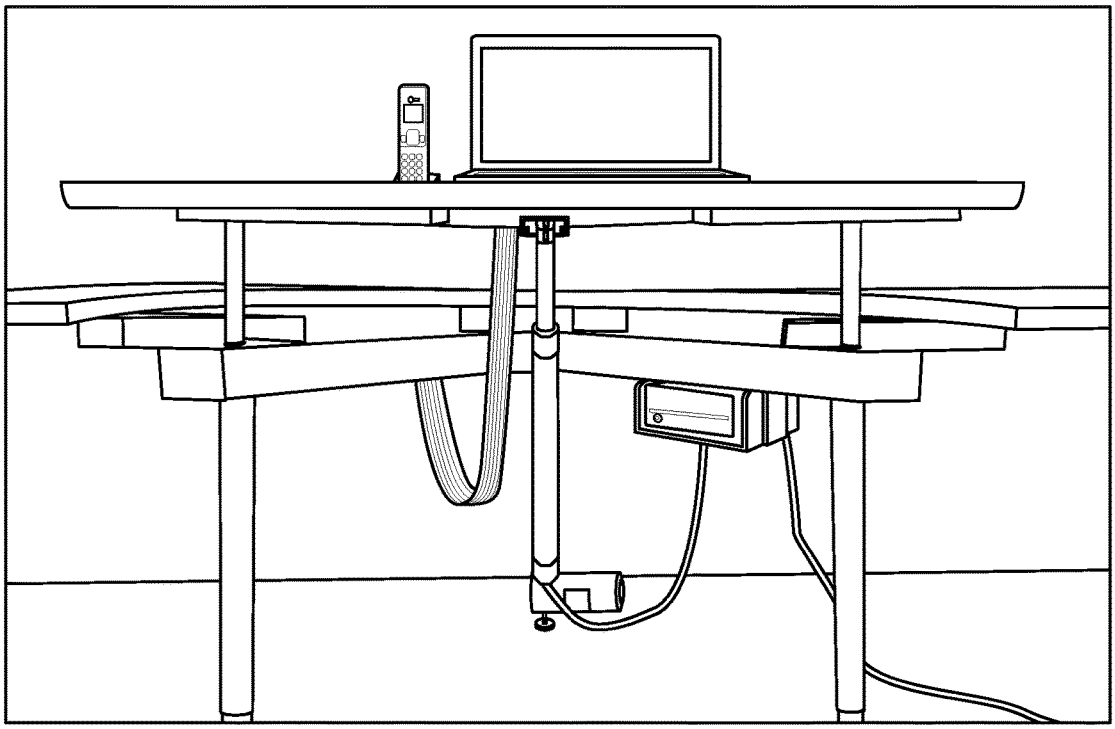
FIG. 2 is a front view of Applicant's invention and, in particular, illustrates the desk as raised in relation to the work surface.

In use, upon activating the actuator 26, the desk 20, or part of the work surface or table 22, through the use of the three telescoping legs or rods 30, may be raised to accommodate a standing position, as desired, or lowered to accommodate a sitting position, as desired. Depending upon this desired position, the desk 20 may remain flush, or in a horizontal seamless alignment with, the rest of the work surface or table 22 or at a different horizontal position than that of the work surface or table 22, such as illustrated in FIG. 2.

Figure 3:
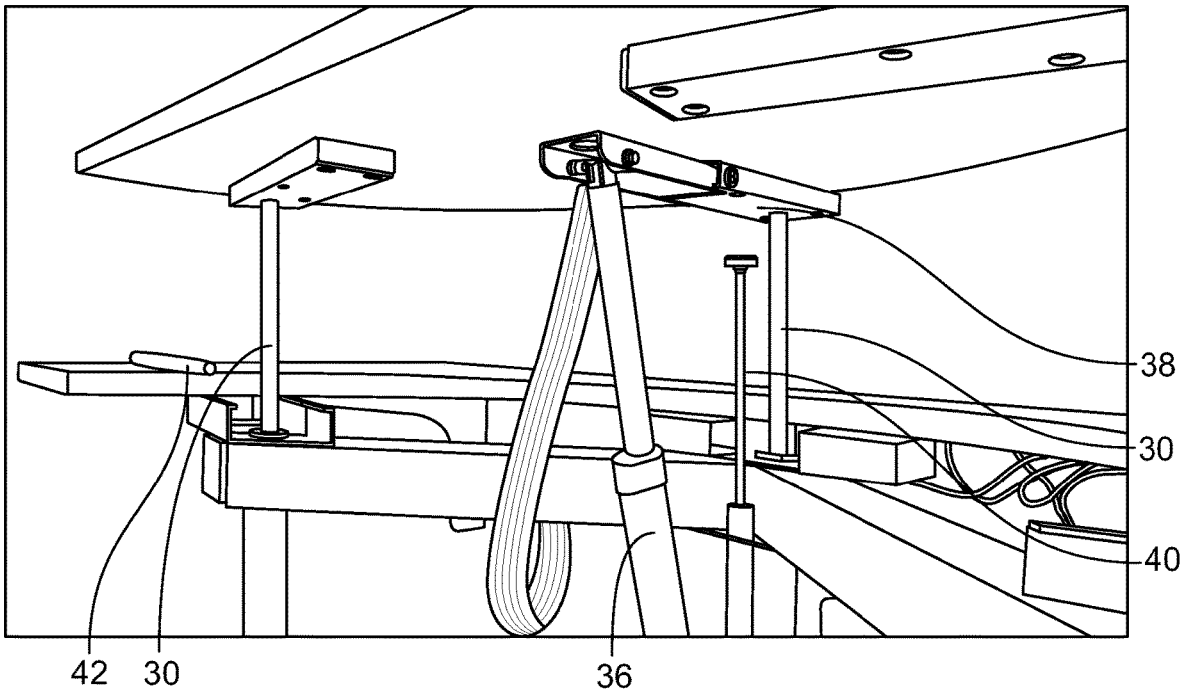
FIG. 3 is a front perspective view of the underside of the desk and, in particular, illustrates two of the three telescoping legs or rods, knee action safety device, and gas spring.
Figure 4:
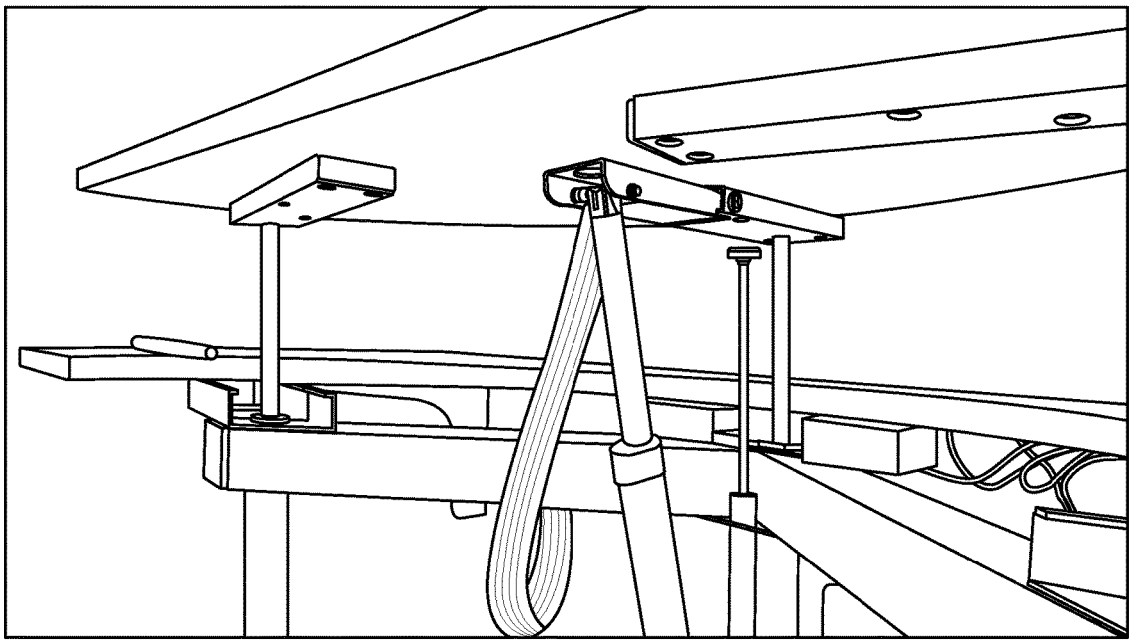
FIG. 4 is a front perspective view of beginning the process of lowering the desk back to its original flush, or in horizontal seamless alignment with, the rest of the work surface; and in particular, illustrating the actuating arm attached to a "knee action" or fold-away joint referred to herein as the "knee action safety device" supporting the desk.

FIGS. 3 through 9 illustrate the process of lowering the desk 20 back to a flush, or horizontal seamless alignment with, the rest of the work surface or table 22 and the safety mechanisms provided to protect the user or others in proximity to this desk 20. For example, resistance of a person's hand or limb between the desk 20 and the work surface or table 22 would immediately be protected by at least the following:

First, an actuating arm 36 attached to a "knee action" or fold-away joint 38 referred to herein as ("knee action safety device 38"). Preferably, the actuating arm 36 is controlled by the actuator 26. To facilitate the lowering of the desk 20, the actuator 26 causes the actuating arm 36 to retract and therefore, allow for the weight of the desk 20 to apply and lower the desk 20, as illustrated in FIGS. 3 and 4. Upon reaching, or within preferably the final 7" of descent or full down position this knee action safety device 38 does not allow any downward pressure from the actuating arm 36 to occur. Also, should the desk 20 incur resistance or an obstruction to its continued lowering, such as from a carrot 42 as illustrated in FIG. 5 (e.g., other examples include a person's hand or fingers, etc. . . . ), although the actuator 26 will continue to cause the actuating arm 36 to retract, the "knee action" or fold-away joint 38 will break away, separate, or disengage from the desk 20, as illustrated in FIGS. 5-7. In this manner, at that moment, the actuating arm 36 is not pulling or otherwise has no continued pulling affect on the desk 20. Only the weight of the desk 20 against any resistance (i.e., such as, in a non-limiting example, a carrot 42, or a person's hand or fingers, etc.) remains or is inadvertently in the way. However, this is solved by the gas spring 40, as discussed further below.

Second, in addition to the knee action safety device 38, there is a gas spring 40 that is calibrated to bear the specific weight of the desk 20 and all weight located on the desk 20, such as the computer workstation devices 24 ("combined weight of the desk 20"). The gas spring 40 is the black rod in the center that takes this combined weight of the desk 20 during lowering should the desk 20 happen to come in contact with resistance or an obstruction (i.e., such as the carrot 42, as illustrated in FIG. 5, or a person's hand or fingers, etc. . . . ). The gas spring 40 engages the desk 20 at preferably 7" of descent or full down position. Alternatively, the gas spring 40 could engage the desk 20 at a larger or smaller distance, as desired. Alternatively, it is contemplated that there could be multiple gas springs, each calibrated to equally share or split the load or bearing of the combined weight of the desk 20 and thereby provide the same effectiveness while at the same time also prolonging the useful life of these parts.

When this occurs, the gas spring 40 supports the weight of the desk 20. For example, if the combined weight of the desk 20 is fifty (50) pounds, the gas spring 40 may be calibrated to support a total of forty-seven (47) pounds. This is referred to herein as the desired weight or resistance weight. In this manner, with the actuating arm 36 not pulling or otherwise having no continued pulling affect on the desk 20, the gas spring 40 is supporting forty-seven (47) pounds and therefore, the continued lowering of the desk 20, even though slower, is being accomplished due to the remaining weight of the desk 20 of three (3) pounds bearing down on the gas spring 40. The difference between the weight of the desk 20 and the desired weight or resistance weight provided by the gas spring 40 is referred to herein as the net lowering weight of the desk 20. If the carrot 42, as illustrated in FIG. 5 (e.g., or a person's hand or fingers, etc. . . . ) causes a resistance or obstruction that supports three (3) pounds, the desk 20 would then stop, as illustrated in FIG. 6. In this manner, and in this preferred embodiment, while the carrot 42 is resisting or obstructing the desk 20, the carrot 42 is only receiving or supporting a total weight of three (3) pounds (i.e., the net lowering weight of the desk 20), not fifty (50) which would likely break the carrot 42 (e.g., or cause injury to a person's hand or fingers, etc. . . . ).

In this manner, the knee action safety device 38 co-acting, or in combination, with the gas spring 40, allows the desk 20 to become virtually weightless during its final descent; thus, eliminating the possibility of a person's limb or hand being crushed or severely injured.

When this occurs, as illustrated in FIGS. 8 and 9, simply lift the desk 20 slightly to allow the carrot 42 (e.g., or a person's hand or fingers, etc. . . . ) to be removed. Once removed, releasing the desk 20, the remaining three (3) pounds weight of the desk 20 bearing down on the gas spring 40 (i.e., in the non-limiting example being used from above) will allow the desk 20 to gradually lower into the flush, or horizontal seamless alignment with, the rest of the work surface or table 22.

As an additional safety feature, a dual switch 44, as illustrated in FIG. 10, is located a safe distance from any moving parts. A momentary key switch 46 is engaged with one hand, while the momentary "up and down" switch 48 is engaged with the other; thus, eliminating any accidental contact during operation. Removal of the key "locks out" any unauthorized person to operate the device.

This design of a sit/stand desk unit can be installed in conjunction with virtually any free-standing desk or cubicle work surface configuration. By raising and lowering only a portion of the desk from the work surface rather than the entire work surface, the remaining work surface can be attached to the cubicle wall system of any and all manufacturers of cubicle office furniture by utilizing their OEM brackets. This invention is attached to the existing work surface through mechanical fasteners, such as screws or bolts. This concept enables the adjusting portion of the work surface to maintain a uniform ⅛" gap that is constant and dependable throughout the life of the unit. Additionally, the unit can adjust from just over 27" to just over 33" desk heights through the use of an 8" tubular inner sleeve with a machined groove to receive a set screw, which locks the position. Final adjustment is achieved by the use of a ¾" threaded adjustable foot.

Thus, there has been provided a unique method for method for raising and lowering a desk within a work surface or table. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the disclosure contained herein and the appended claims.

What is claimed is:

1. A method for raising and lowering a desk in relation to a work surface, comprising the steps of:

providing the desk in close proximity to the work surface;

defining the desk in horizontal alignment in relation to the work surface as an original position, the desk providing a top surface and a bottom surface;

providing an actuating arm and a means for controlling the actuating arm;

activating the means for controlling the actuating arm and extending the actuating arm;

engaging the actuating arm with the bottom surface of the desk;

raising the desk from the original position to a raised position that is separated from the work surface;

lowering the desk from the raised position back to the original position using the following, steps;

(a) activating the means for controlling the actuating arm to retract the actuating arm;

(b) retracting the actuating arm at a first rate of descent and allowing the weight of the desk to cause the desk to begin lowering at the same first rate of descent;

(c) defining a final descent distance measured between the desk and the work surface;

(d) providing a gas spring fixed in a position relative to the bottom surface of the desk;

(e) during the lowering, engaging the gas spring with the bottom surface of the desk at the final descent distance;

(f) if an obstruction is encountered between the desk and the work surface preventing the desk from continuing to lower at the first rate of descent, performing the following additional steps:

(i) continuing to retract the actuating arm at the first rate of descent and disengaging the actuating arm from the bottom surface of the desk;

(ii) supporting the desk with the gas spring as the actuating arm is retracting and disengaging from the bottom surface of the desk, the gas spring limiting the weight of the desk engaging the obstruction to prevent damage to the obstruction;

(iii) lifting the desk to allow removal of the obstruction;

(iv) allowing the weight of the desk to continue to lower until the desk is back in the original position in relation to the work surface.

2. The method of claim 1 and further comprising the step of providing the work surface in a stationary position.

3. The method of claim 1 and further comprising the step of providing the desk flush with the work surface when the desk is in the original position.

4. The method of claim 1 and further comprising the step of, during the lowering of the desk, supporting the weight of the desk by the actuating arm as the actuating arm is being retracted.

5. The method of claim 1 and further comprising, the step of removing all support of the desk by the actuating arm when the actuating arm is disengaged from the desk.

6. The method of claim 1 and further comprising the step of calibrating the gas spring to support a desired weight of the desk.

7. The method of claim 6 and further comprising the step of defining the difference between the weight of the desk and the desired weight to be a net lowering weight of the desk.

8. The method of claim 7 and further comprising the step of allowing only the net lowering weight of the desk to engage the obstruction.

9. The method of claim 1 and further comprising the step of defining the final descent distance to be substantially seven inches.

10. The method of claim 1 and further comprising the step of providing a switch to activate the raising or lowering of the desk.

11. A method for raising and lowering a desk in relation to a work surface, comprising the steps of:

defining the desk in horizontal alignment in relation to the work surface as a first position, the desk providing a top surface and a bottom surface;

moving the desk from the first position to a second position that is separated from the work surface using the following steps;

(a) providing an moveable arm and a means for controlling the moveable arm;

(b) using the means for controlling the moveable arm and moving the moveable arm;

(c) engaging the moveable arm with the desk and forcing the desk to move from the first position to the second position;

moving the desk from the second position back to the first position using the following steps;

(d) using the means for controlling the ON cable arm and moving the moveable, arm;

(e) retracting the moveable arm at a rate of descent and allowing the weight of the desk to cause the desk to begin lowering at the same rate of descent;

(f) providing a gas spring fixed in a position relative to the bottom surface of the desk;

(g) during the lowering, engaging a gas spring to the desk, the gas spring providing a resistance weight;

(h) defining the difference between the weight of the desk and the resistance weight to be a net lowering weight of the desk;

(i) if an obstruction is encountered between the desk and the work surface causing the desk from continuing to lower at the rate of descent, performing the following additional steps:

(i) continuing to retract the moveable arm at the rate of descent and disengaging the moveable arm from the desk;

(ii) allowing only the net lowering weight of the desk to engage the obstruction;

(iii) lifting the desk to allow removal of the obstruction;

(iv) allowing the net lowering weight of the desk to continue to lower the desk until the desk is back in the original position in relation to the work surface.

12. The method of claim 11 and further comprising the step of calibrating the gas spring to provide the resistance weight.

13. The method of claim 11 and further comprising the step of removing all support of the desk by the moveable arm when the moveable arm is disengaged from the desk.

* * * * *